United States Patent [19]

Nakagawa et al.

[11] Patent Number: 4,877,370

[45] Date of Patent: Oct. 31, 1989

[54] DIFFUSER FOR CENTRIFUGAL COMPRESSOR

[75] Inventors: Koji Nakagawa, Tsuchiura; Takeo Takagi, Tsukuba; Yoshiaki Abe; Haruki Sakai, both of Ibaraki, all of Japan

[73] Assignee: Hitachi, Ltd., Tokyo, Japan

[21] Appl. No.: 238,176

[22] Filed: Aug. 30, 1988

[30] Foreign Application Priority Data

Sep. 1, 1987 [JP] Japan ..... 62-218941
Sep. 28, 1987 [JP] Japan ..... 62-240737

[51] Int. Cl.[4] ..... F04D 29/30
[52] U.S. Cl. ..... 415/148; 415/208.4
[58] Field of Search ..... 415/211, 181, DIG. 1, 415/148, 150, 208.4

[56] References Cited

U.S. PATENT DOCUMENTS 3,184,152 5/1965 Bourquard ..... 415/211
3,588,270 6/1971 Boelcs ..... 415/181
3,765,792 10/1973 Exley ..... 415/208.4 X
4,354,802 10/1982 Nishida et al. ..... 415/211

FOREIGN PATENT DOCUMENTS 46583 2/1964 Japan ..... 415/DIG. 1
53-119411 10/1978 Japan .
57-159998 10/1982 Japan .
61-38198 2/1986 Japan ..... 415/211

*Primary Examiner*—Robert E. Garrett
*Assistant Examiner*—Joseph M. Pitko
*Attorney, Agent, or Firm*—Antonelli, Terry & Wands

[57] ABSTRACT

A diffuser centrifugal compressor of a comprising a plurality of stator blades provided outside an impeller thereof, and which converts kinetic energy of fluid from the impeller into pressure energy by operation of the stator blade. The diffuser is provided with sub-blades near the inner ends of the stator blades, and intermediate blades near outer ends of and between the stator blades.

12 Claims, 8 Drawing Sheets

DIFFUSER FOR CENTRIFUGAL COMPRESSOR

BACKGROUND OF THE INVENTION

1. Field of the Invention

This invention relates to a diffuser for a centrifugal compressor, and, more particularly, to a diffuser suitable for use in a high speed centrifugal compressor in which high pressure ratio can be obtained by a single stage.

2. Description of Prior Art

Generally, a centrifugal compressor generates a high speed air flow by the rotation of an impeller thereof. In a case of a high speed centrifugal compressor which is so designed that high pressure ratio can be obtained through a single stage, since the speed of air discharged from the impeller exceeds sonic velocity, a diffuser having stator blades is provided in an area outside the impeller, with this outside area corresponding to the downstream of the impeller, for the purpose of converting kinetic energy of the fluid discharged from the impeller into pressure energy.

A plurality of stator blades forming the diffuser is provided in a peripheral portion or outside area of the impeller, and spaces between these stator blades form diffuser passages.

In the above-described type of compressor, when the rotational speed is relatively high and discharge (flow rate) is also relatively small, a separation flow region is generated in the negative pressure side of the stator blade, as a result of which, a problem arises such that the surge phenomenon is generated in which sufficient rise in pressure cannot be obtained. A diffuser for high speed centrifugal compressor which can overcome the above-described problem and in which the surging phenomenon is prevented even if in the high speed and small discharge state, was proposed and disclosed in Japanese Patent Laid-Open No. 57-159998, in which fluid passing through a diffuser is controlled by a rotatable sub-blade at the inlet portion of the diffuser for the purpose of controlling the fluid passing through the diffuser. Furthermore, in Japanese Patent Laid-Open No. 53-119411, it is proposed that a blade-provided diffuser is formed in a double circular blade cascade and the length of the blade in the inner annular blade cascade is arranged to be no more than 0.9 times of the interval of the blades.

However, in the former case, since the diffuser passage formed between stator blades is drastically enlarged immediately behind the downstream of the sub-blade, a problem arises such that pressure loss is generated, and the choking flow is reduced, causing the performance of the diffuser to be deteriorated. Meanwhile, in the latter case, although the above-described problem of reduction in choking flow does not arise, a loss is generated due to a strong shear flow generated at the downstream of the blades of the inner circular blade cascade when the speed of the fluid at the inlet portion of the blades which form the inner circular blade cascade exceeds sound velocity. As a result, a problem arises such that the performance of the diffuser is deteriorated.

SUMMARY OF THE INVENTION

An object of the present invention is to provide a diffuser for a centrifugal compressor which can overcome the above-described problems and which exhibits wide operating range and high performance.

In accordance with advantageous features of the present invention a diffuser for a centrifugal compressor of the type including a plurality of stator blades disposed on an outer side of an impeller which converts kinetic energy of fluid discharged from the impeller into pressure energy by operation of the stator blades is provided wherein the diffuser includes a sub-blade having a cord length shorter a cord length of the stator blade and disposed near an inner end of and between the plurality of stator blades, with only one side surface of the sub-blade confronting the stator blade. The sub-blade is situated at positions intersecting a circle which have a center thereof at a center of a rotational shaft of the impeller and which passes through the inner end of the stator blade. Preferably, intermediate blades are disposed near the outer circumference or ends of and between the plurality of stator blades, and have a cord length shorter than a cord length of the stator blade. Each of the intermediate blades extends through the middle point of a perpendicular line drawn from an outer edge of the stator blade to a neighboring stator blade or to an extension of inside of the neighboring blade, whose outer edge reaches a circle which passes through an outer edge of the stator blade. The length of the intermediate blade disposed inside the middle portion of the perpendicular line is no more than 20% of an overall length of the intermediate blade, and a whole shape of the intermediate blade is formed in such a manner that, if the intermediate blade is presumed to be rotationally displaced by a certain angle around the center of a rotational shaft of the impeller, the intermediate blade is included in a contour of the stator blade.

In the above-described construction, since only one side of the sub-blade confronts the stator blade forming the diffuser, this sub-blade does not enter the region in which the flow is strictly restricted by the neighboring stator blade. Therefore, the drastic or rapid enlargement of the cross sectional area of the flow passage and reduction in the choking flow immediately behind the downstream of the sub-blade do not occur. Furthermore, since only one side of the sub-blade confronts the stator blade, the distance between the front edge of the region disposed between the stator blades and the rear edge of the sub-blade is relatively short. Therefore, the region which may generate the strong shear flow can be limited short, causing loss to be low.

It is preferable for the inner sub-blade to be made as thin as possible, however, a certain thickness is required for keeping strength. Therefore, the number of the stator blades needs to be selected to secure sufficient cross sectional area of flow. In such a case, the performance may be lowered, because the flow passage near the outer periphery of the stator blade, or the interval of the stator blades is excessively enlarged. However, since intermediate blades are extended near the outer periphery of and between stator blades in such a manner that the intermediate blade extends through the middle point of a perpendicular line from the outer end of the stator blade to the blade surface of the neighboring blade, the intervals of the stator blades can be made proper value near the outer periphery of the stator blade. As a result of this, reduction in performance can be prevented.

DESCRIPTION OF PREFERRED EMBODIMENTS

Figure 1:
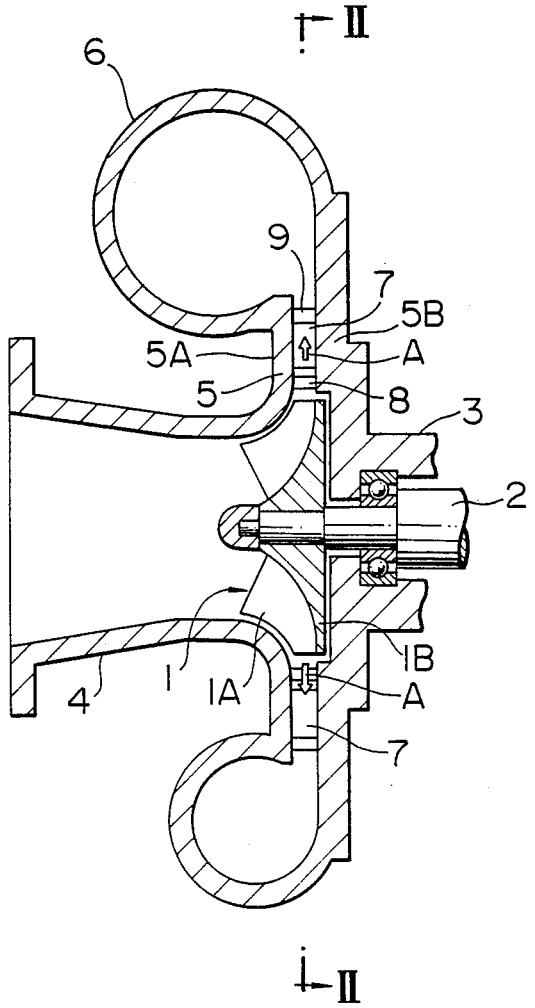
FIG. 1 is a sectional view of a diffuser for a centrifugal compressor according to one embodiment of the present invention.
Figure 2:
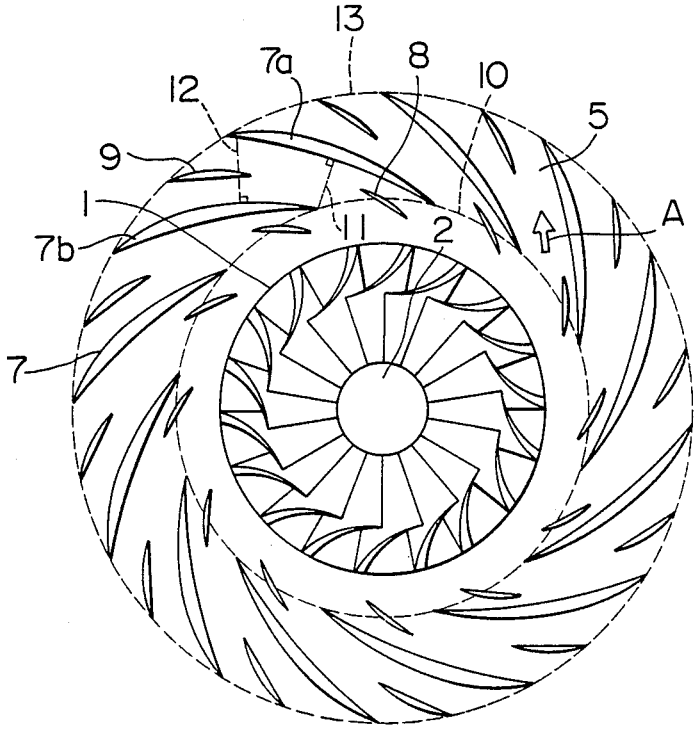
FIG. 2 is a cross-sectional view taken along the line II—II in FIG. 1.
Figure 3:
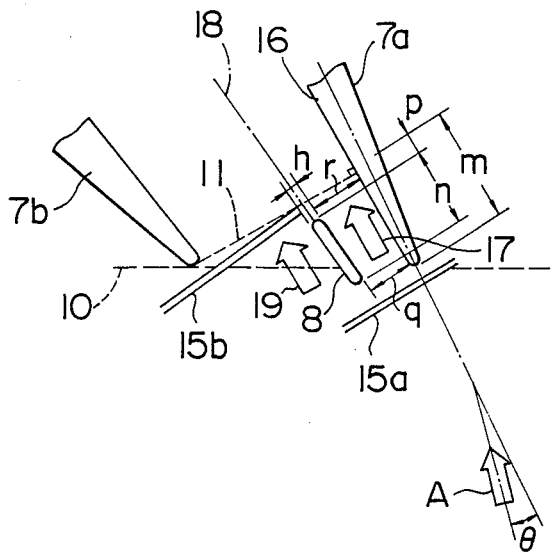
FIGS. 3 to 6 are diagrams respectively illustrating the operation of the diffuser according to an embodiment of the present invention.

Referring now to the drawings wherein like reference numerals are used throughout the various views to designate like parts and, more particularly, to FIGS. 1–3, according to these figures, a centrifugal compressor includes an impeller generally designated by the reference numeral 1 formed by blades 1A and a core plate 1B, a rotational shaft 2 connected to a driving means or motor (not shown), a casing 3, a suction pipe 4, a diffuser portions 5, and a scroll casing 6. The diffuser portion 5 includes a blade-side diffuser casing 5A, a core-side diffuser casing 5B, a plurality of stator blades 7 disposed, as shown in FIG. 2, between the diffuser casings 5A 5B, and intermediate blades 9 and sub-blades 8 provided for the blade-side diffuser casing 5A or the core-side diffuser casing 5B in such a manner that the same project into the diffuser flow passage between the stator blades.

The sub-blades 8 are disposed in such a manner that they intersect a circle making the center of the rotational shaft 2 of the impeller 1 as its center and passing the inner end or edge (front end or edge) of the stator blade 7. Assuming that a perpendicular line drawn from the front end of a stator blade **7*b*, situated at a side of a center of radius of curvature of a neighboring stator blade 7*a*, down to the other stator blade 7*a* is represented by reference numeral 11, the sub-blade 8 is disposed not to intersect this perpendicular line 11. The intermediate blades 9 are disposed in such a manner that they pass the middle point of a perpendicular line 12 drawn from the rear end (outer end) of the stator blade 7*a* to the neighboring stator blade 7*b* and the rear end or edge of the intermediate blade 9 reaches a circle which passes through the outer periphery or rear ends or edges of the stator blades 7. The length of the intermediate blade 9 projecting from the middle point of the perpendicular line 12 toward inside is no more than 20% of the overall length of this intermediate blade 9. The whole shape of the intermediate blade 9 is designed such that the blade 9 is included in the stator blade 7 if this intermediate blade 9 is assumed to be rotationally displaced by a certain angle around the center of the rotational shaft 2. Furthermore, the stator blades 7, the sub-blades 8 and the intermediate blades 9 are respectively restricted at their both ends by the confronting casings 5A and 5B in the diffuser portion with the resulting space forming the diffuser portion 5**.

In operation of the diffuser, the kinetic energy of air flow A discharged from the impeller 1 is converted into pressure energy and the air is compressed at the time of its passing through the diffuser portion 5. In high speed centrifugal compressors, since the flow velocity of air flow A introduced into the diffuser portion 5 exceeds sound velocity, a shock wave is generated, causing the flow velocity to be reduced to subsonic speed. FIG. 3 shows strong shock waves which are generated near the front ends of the blades 7 and 8, and which affect the flow, such shock waves being generated in a case where the Mach number of the air flow A approximates 1 (for example 1.1 or less). The angle $\theta$ defined by the air flow A and the stator blade 7 is changed in accordance with the flow rate of air compressed by the compressor. However, since the strong shock wave is generated at the front end of the blade, the state shown in FIG. 3 is not changed. A shock wave 15 generated near the stator blade 7 is only around the blade 7, but it does not strike or reach the other type of blades, that is, sub-blade 8 or stator blade 7. The shock wave **15*a* generated at the front end of the stator blade 7*a* does not strike or reach the sub-blade 8 and neighboring stator blade 7*b* since the shock wave 15*a* is extended substantially perpendicular to the stator blade 7*a* in a case where the Mach number of the air flow A approximates 1. Subsonic flow 17 passes through a region situated between the sub-blade 8 and the negative pressure side 16 of the stator blade 7*a* and a region in its downstream between a dashed line 18 and the negative pressure side 16. Since the shock waves are generated when a supersonic flow is decelerated to a subsonic flow, the shock wave 15*b* generated at the front end of the stator blade 7*b* confronting the stator blade 7*a* only reaches the dashed line 18, and it does not reach the negative pressure side 16 of the stator blade 7*a*. By provision of the sub-blade 8 in the manner as described above, the shock wave is prevented from reaching the negative pressure side 16**, and the operating range can be enlarged by avoiding the occurrence of surging phenomenon.

In general, pressure in the direction of air flow passing through the blade-provided diffuser rises according to the reduction in the flow rate of the compressor. If it exceeds a certain limit, the same generates a back run, causing the stop of normal compressing function. Thus, so-called surging phenomenon is generated, and the compressor cannot be operated normally. The limit causing the diffuser to generate the back run is varied in accordance with the shape of the stator blade or the like. The generation of the back run is likely to be easily generated by separation of the air flow from the surface of the stator blade or the wall surfaces facing both sides of the stator blade. In general, separation of the air flow from the negative pressure side of the stator blade is a major cause. In this state, if the shock wave has reached the negative pressure side, the boundary layer along the negative pressure side is likely to undergo, due to strong rise in pressure in front of and behind the shock wave, rapid increase in its thickness, partial separation, or large scale of separation depending on circumstances. Therefore, the separation of the air flow layer from the negative pressure side can be substantially prevented and the limit causing the back run can be shifted to lower flow rate range by preventing the shock wave from reaching the negative pressure side. Namely, occurrence of surging phenomenon due to the diffuser can be suppressed.

The larger or higher flow rate limit of the air flow is defined in accordance with the minimum cross-sectional area of the flow passage in the diffuser portion. Therefore, referring to FIG. 3, it is defined by the length of the perpendicular or normal line 11 drawn from the front end of the stator blade *7b* to the negative pressure side 16 of the stator blade *7a*. In this case, since the sub-blade 8 does not intersect the perpendicular line 11, avoiding the perpendicular line 11 to be shortened, it does not affect the larger flow rate limit. As described above, do to the provision of the sub-blade 8, the smaller or lower flow rate limit can be shifted to smaller flow rate range without any reduction in the larger flow rate limit.

The above-described effect of enlarging the flow rate range by the sub-blade 8 is improved when the sub-blade 8 satisfies the following condition without any deterioration in the performance of the diffuser: a first condition is; the rear end of the sub-blade 8 is situated at an upstream side of the perpendicular line 11. If the sub-blade 8 intersects the perpendicular line 11, the maximum flow rate, as described, decreases and the pressure loss is generated as well due to the rapid enlargement of the cross-sectional area of the flow passage. That is, since the passage situated at the downstream of the perpendicular line 11 is located between the stator blades *7a* and *7b*, the width of the passage is rapidly or drastically enlarged by the thickness h of the rear end if the rear end of the sub-blade 8 is situated at a position downstream of the perpendicular line 11. On the other hand, in the region within a distance p between the rear end of the sub-blade 8 and the perpendicular line 11, since the air flow 17 which has been reduced in its velocity to subsonic after passing between the sub-blade 8 and the stator blade *7b* and the supersonic flow 19 at the upstream of the shock wave 15*b* are brought into contact with each other and mixed each other, large pressure loss is generated. Therefore, the distance p is required to be small enough. The distance p is required or preferred to be 50% or less of the distance m between the front end of the stator blade *7b* and the perpendicular line 11.

The second condition is: the ratio r/q of the distance r at the outlet between the sub-blade 8 and the stator blade *7a* with respect to the distance q at the inlet of the sub-blade 8 and the stator blade *7a* is approximately 1, for example, it being 1 to 1.1. If r/q is made outside of this range, the flow will be separated from the surface of the sub-blade 8, causing loss at the downstream of the sub-blade 8 or stator blade *7a*, to be increased.

The third condition is: the ratio n/q of the length n of the portion where the sub-blade 8 and the stator blade 7 confronts each other with respect to the distance q between the front end of the stator blade *7a* and the surface of the sub-blade 8 is required to be larger than 1 for the purpose of ensuring to make the air flow 17 subsonic.

According to this embodiment, since the sub-blade 8 does not protrude into the region where the flow is strictly restricted between the stator blades *7a* and *7b*, the rapid enlargement of the cross-sectional area of the flow passage and reduction in the choking flow rate at the immediately downstream of the sub-blade 8 do not occur. Furthermore, the distance between the outer end of the sub-blade 8 and the perpendicular line 11 is relatively short, and the region in which strong shear flow occurs is thereby short, reducing the pressure loss. Since the rear end of the sub-blade 8 is situated between the front end of the stator blade *7a* and the front end of the stator blade *7b*, a shock wave does not reach the surface of the stator blade *7a*, reducing the fear of the air flow 17 to be separated from the surface of the stator blade *7a*. As a result of this, the range of flow rate where the diffuser portion 5 can be normally operated can be enlarged.

Figure 4:
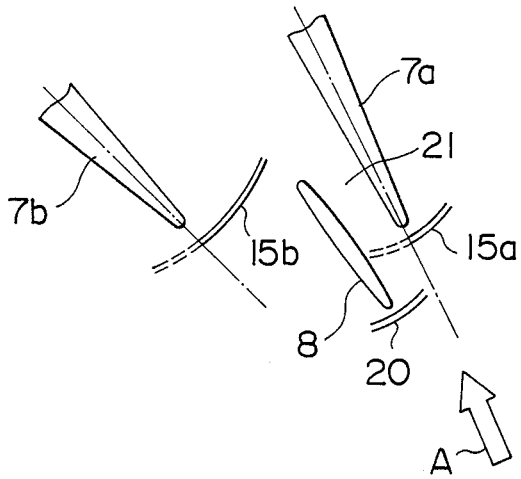

FIG. 4 shows a preferred embodiment for use in a case where the Mach number of the air flow A introduced into the diffuser exceeds 1.1. In embodiment of FIG. 4, the front end of the sub-blade 8 is situated at the upstream of the front end of the stator blade *7a*. When the Mach number of the air flow A increases, wave front of the shock waves 15 and 20 are bent or curved. Therefore, in order to prevent occurrence of collision of the shock wave 15*a* with the surface of the sub-blade 8, shock wave 20 is generated at the front end of the sub-blade 8 for the purpose of making the flow subsonic which passes through a passage 21 between the sub-blade 8 and the stator blade *7a*.

The sub-blade 8 is, in the viewpoint of aerodynamics, preferable to be made as thin as possible, but it is required to be thick enough to have a reasonable strength structurally. That is, an appropriate length should be selected depending on the thickness (for example, 5 to 10 times of the thickness). In this state, the number of the stator blades needs to be selected to satisfy the above-mentioned relationship between the stator blade 7 and the sub-blade 8. In general, it should be decreased down to 80% or less with respect to the case where no sub-blade 8 is provided. As described above, by decreasing the number of the stator blades 7, the interval between stator blades 7 becomes too large near the outer periphery (outlet side), which may prevent the flow from passing along the surface of the stator blade 7 to result in the reduction of the performance.

Figure 5:
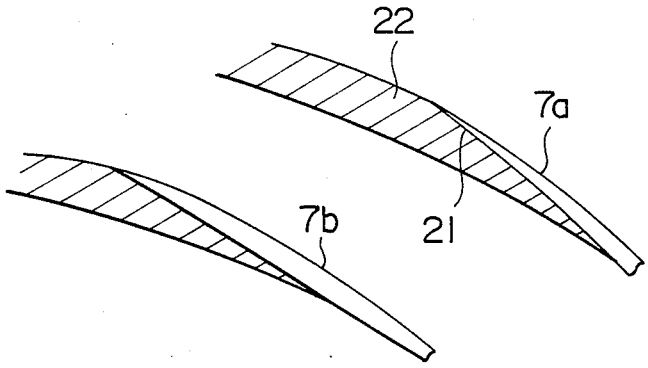
Figure 6:
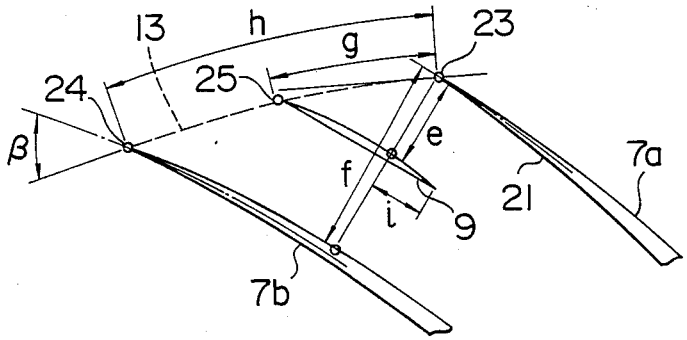

With reference to FIGS. 5 and 6, the operation or action of the intermediate blade 9 will now be explained. FIG. 5 shows a case where such intermediate blade is not provided, wherein the flow does not pass the surface of the blade on the negative pressure side 21 near the rear end of the stator blade *7a*, causing large separation region 22 to be generated. This generation of the large separation region causes the reduction in the substantial cross-sectional area. As a result of this, the velocity reduction in the diffuser deteriorates and the kinetic energy is dissipated in the separation region, causing the performance of the diffuser to be deteriorated. Such a type of large separation can be prevented by reducing load (deceleration) on the negative pressure side 21 near the rear end. This will be described with reference to FIG. 6. The amount of deceleration on a negative pressure side 21 near the rear end of the stator blade *7a* can be expressed, according to the one-dimensional flow theory, as $h \cdot \sin \beta / f - 1$ by using the circumferential distance h between a rear end 23 of the stator blade *7a* and a rear end 24 of the stator blade *7b*, the outlet angle $\beta$ of the stator blade 7, and the length f of the perpendicular or normal line drawn from the rear end 23 of the stator blade *7a* to its neighboring stator blade *7b*. As this value becomes larger, the deceleration load becomes larger. The value $h \cdot \sin \beta / f - 1$ is determined in accordance with the shape and the number of the stator blades and as the number of the blades become large, the value becomes small with Table 1 providing examples. In the case where the intermediate blades 9 are provided, the amount of deceleration near the rear end negative pressure side of the stator blade *7a* can be expressed as $g \cdot \sin \beta / e - 1$ by the same reason as above. A deceleration load when the intermediate blade is provided is also shown on Table 1. As shown on Table 1, do to the provision of the intermediate blade 9, the deceleration of 23% can be 19% in a case where the number of the stator blades is seventeen. As a result, the amount of deceleration can be reduced by 20%, causing the occurrence of large separation near the rear end of the negative pressure side to be suppressed.

TABLE 1

| The number of stator blades | Effect of Intermediate blades 21 | 17 | 17(with intermediate blade) |
|---|---|---|---|
| $h \cdot \sin\beta/f-1$ | 0.16 | 0.23 | — |
| $g \cdot \sin\beta/e-1$ | — | — | 0.19 |

As described above, since the intermediate blade 9 serves to prevent the occurrence or generation of the large separation near the rear end of the stator blade *7a*, the intermediate blade 9 is arranged in such a manner, for the purpose of ensuring to restrict the flow near the rear end of the stator blade 7, that it intersects the perpendicular line drawn from the rear end 23 of the stator blade *7a* to the neighboring stator blade *7b*, and that the rear end 25 reaches the circle 13. If the length of the intermediate blade is too long, the area which comes contact with the flow is increased. Therefore, the length i of the intermediate blade 9 which is situated inner than the above-described perpendicular line is arranged to be within 20% of the overall length of the intermediate blade 9. Since the flow at the upstream of the perpendicular line involves relatively small ununiformity, the intermediate blade 9 passes through the middle point of the perpendicular line to equally divide the flow so that the flow at the outlet of the diffuser is made uniform. As a result of this, occurrence of additional loss due to non-uniform flow can be prevented. Since the overall shape of the intermediate blade 9 is formed in such a manner that, if the intermediate blade 9 is virtually or assumed to be rotationally displaced around the center of the rotational shaft 2, it is included within the contour of the stator blade 7, the flow can pass through smoothly, causing occurrence of loss to be reduced.

Figure 7:
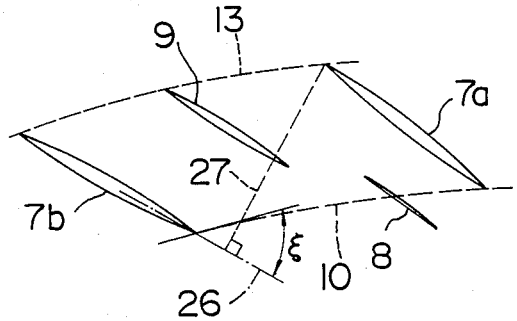
FIGS. 7 to 9 are enlarged views respectively illustrating portions of other embodiments of the present invention.

FIG. 7 illustrates an embodiment in which the perpendicular line cannot be drawn from the rear end of the stator blade *7a* onto the neighboring stator blade *7b*, since the length of the chord of the stator blade 7 is too short In this case, a perpendicular line 27 is used which is drawn to an extension 26 of the mean thickness line at the front end of the stator blade *7b*. This extension line 26 may be formed by a straight line, but a logarithmic spiral passing through the front end of the stator blade *7b* and forming an inlet angle $\xi$ achieves the same effect.

Figure 8:
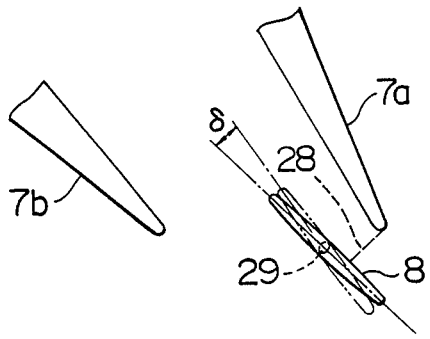

In FIG. 8 the sub-blade 8 is rotatably, by an angular extent 6, supported by a supporting shaft 29 which is disposed in parallel to the rotational shaft 2 of the impeller 1. In large flow rate operation mode, the length of a perpendicular line 28 drawn from the front end of the stator blade *7b* to the sub-blade 8 is selected to be greater, while in small flow rate operation mode, the length of the perpendicular line 28 is selected to be smaller. As a result of this, the flow rate range can be further enlarged to the throttling effect. In the embodiment of FIG. 8, the supporting shaft 29 for the sub-blade 8 may be manually rotated. The supporting shaft 29 for the sub-blade 8 may be arranged to be automatically operated by an appropriate control unit for controlling an apparatus including the centrifugal compressor. According to the embodiment of FIG. 8, the flow rate range can be enlarged due to the above-described operation so that practical advantage can be further improved.

Figure 9:
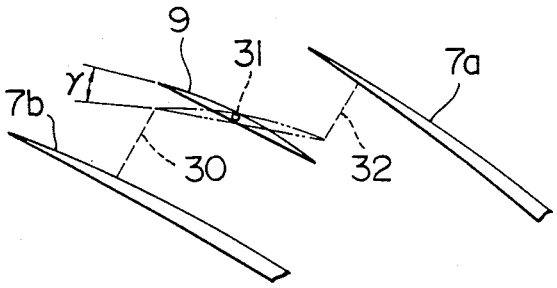

In the embodiment of FIG. 9, the intermediate blade 9 is rotatably, by an angular extent $\gamma$, supported by a supporting shaft 31 disposed in parallel to the rotational shaft 2 of the impeller 1. The sum of the length of a perpendicular line 32 drawn from the front end of the intermediate blade 9 to the neighboring stator blade *7a* and the length of a perpendicular line 30 drawn from the rear end of the intermediate blade 9 to the neighboring blade *7b* is made greater in a large flow rate mode, while the sum is made smaller in a small flow rate mode. The same effect as that in the embodiment shown in FIG. 8 is intended to be obtained in which the flow rate range is enlarged by the throtting effect. If the embodiment of FIG. 9 is employed in combination with rotation control of the sub-blade 8, a better effect can be obtained.

As described above, according to the present invention, since the diffuser for converting kinetic energy of the air flow discharged from an impeller of a centrifugal compressor into pressure energy comprises, in addition to a plurality of stator blades, sub-blades at positions intersecting a circle which passes through the front ends of the stator blades such that one side surface of each sub-blade confronts the associated stator blade, and intermediate blades passing through the middle point drawn from the rear end of the stator blade to the neighboring stator blade and reaching a circle which passes the rear ends of the stator blades, the operatable flow rate range of the diffuser can be enlarged without reduction in the performance. As a result of this, the operable flow rate range of a high speed centrifugal compressor can be significantly enlarged.

Figure 10:
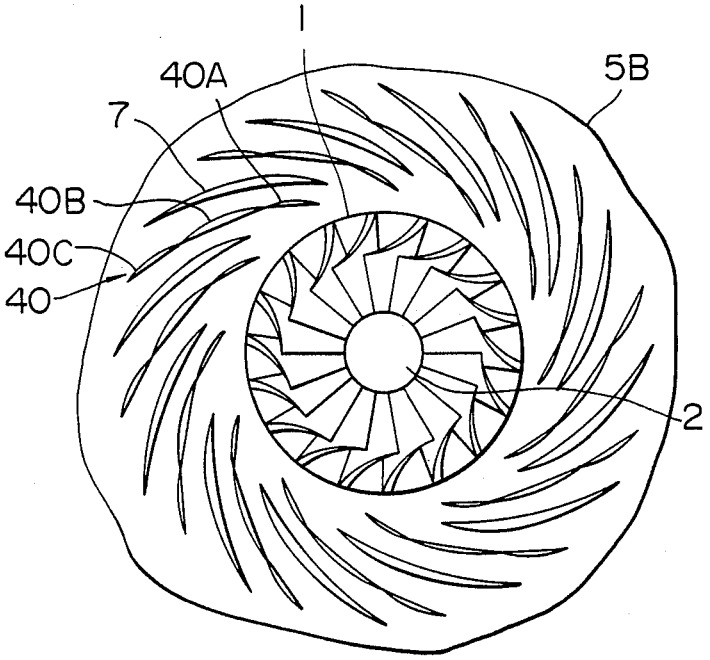
FIG. 10 is a cross-sectional view of a diffuser for a centrifugal compressor according to a still another embodiment of the present invention.
Figure 11:
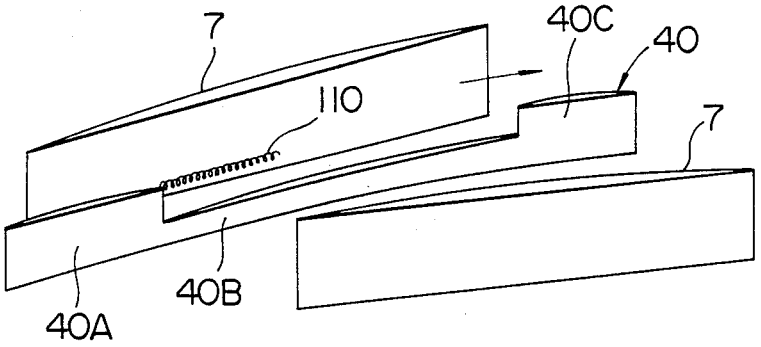
FIG. 11 is a perspective view of the diffuser portion according to the embodiment shown in FIG. 10.

In FIGS. 10 and 11, the intermediate blades 40 are provided at the blade-side diffuser casing 5A in such a manner that the intermediate blades 40 project into the diffuser flow passage between the stator blades 7. Each of the intermediate blade 40 comprises as shown in FIGS. 10 and 11, an inlet-side intermediate blade 40A having length of chord and height smaller than those of the stator blade; a rectifier blade 40B with the height shorter than that of the inlet-side intermediate blade 40A, and outlet-side intermediate blades 40C connected with the rectifier blade 40B and having the same or similar dimensions as those of the inlet-side intermediate blade 40A.

The operation of this embodiment of the present invention will be described with reference to FIGS. 10 and 11 as well as FIG. 1.

Fluid is given energy to become a high speed flow while it is passed through the suction pipe 4 and the impeller 1 by the rotation of the impeller 1 and is introduced into the diffuser portion 5. In this diffuser portion 5, fluid discharged from the impeller 1 is introduced into the scroll casing 6 with main part of its kinetic or speed energy being converted into pressure energy. The rest of the fluid kinetic or speed energy has been further converted into pressure energy in the scroll casing 6, and then it is discharged from a discharge port not shown.

Since the inlet-side intermediate blades 40A of the intermediate blades 40 guide the flow along the stator blades 7, the flow can be made pass along the stator blades 7 even if the flow rate is small or low. Therefore, the possibility of the occurrence of a surging phenomenon can be reduced, and the operating range of the impeller 1 can be enlarged. Since the inlet-side intermediate blade 40A acts as described above, the height of the blade is preferably arranged to be in the order of 50% of that of the stator blade 7. Since the inlet-side intermediate blades 40A are overhung from the blade-side diffuser casing 5A, the protruded height is preferably short for the purpose of securing strength. Therefore, it is made shorter than the height of the stator blade 7. Since the inlet-side intermediate blade 40A narrows the flow passage, the inlet-side intermediate blade 40A acts as a resistance if the discharging flow rate of the compressor exceeds the designed value. Also from this viewpoint, the height of the blade is preferable to be as short as possible, it being preferable to be within 70% of the height of the stator blade 7.

A strong vortex flow 110 is, as shown in FIG. 11, generated at the end and the root portion of the inlet-side intermediate blade 40A, i.e. at the downstream end thereof. Energy of the vortex flow is converted into heat energy to cause energy loss. The vortex flow discharged from the downstream end of the root portion, in particular, disturbes the flow in the diffuser 5, causing large loss. The rectifier blades 40B provided at the downstream of the inlet intermediate blades 40A serve to suppress generation of the vortex flow at the root portions of the inlet intermediate blades 40A, thereby serving to reduce the loss. Since the rectifier blade 40B is provided for the purpose of preventing generation of vortex flow, the height of the same may be arranged to be shorter than that of the inlet intermediate blade 40A.

The flow near the outer peripheral between the stator blades 7 is, in general, directed not along nearer the stator blade 7, but along nearer the circumferential direction. Therefore, the outlet-side intermediate blades 40C are provided to guide the flow along the stator blades 7 so that the performance of the diffuser is improved. The height of the outlet-side intermediate blade 40C is preferably in the order of 50% of that of the stator blade 7 however, from the rigidity, it is preferable to be within 70%.

Figure 12:
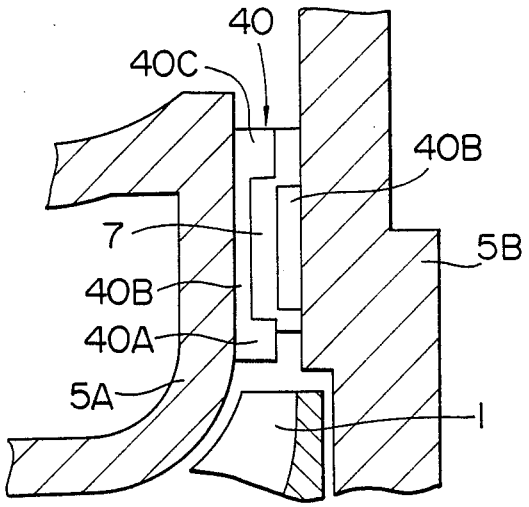
FIGS. 12 to 15 are enlarged views respectively illustrating an portion of yet other embodiments of the present invention.

In the embodiment of FIG. 12, the rectifier blades 40B are provided not only at a first side or face supporting the intermediate blade 40 but also at a second side or face which confronts the first side. In this case, vortex flows generated at downstream end of the inlet intermediate blade 40A as well as at the root of the same can be prevented from generation. Therefore, a further improvement in performance can be achieved.

Figure 13:
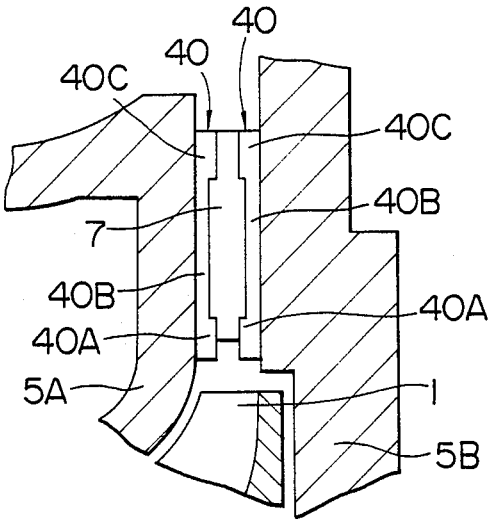

In the embodiment of FIG. 13, the intermediate blade 40 is provided at each of the stator blades in a confronting manner. The same effect as that obtained in the above-described embodiments can be obtained by this structure. In this case, the height of the intermediate blade 40 is half as that of the intermediate blade 40 employed in the embodiments shown in FIGS. 10 and 12.

Figure 14:
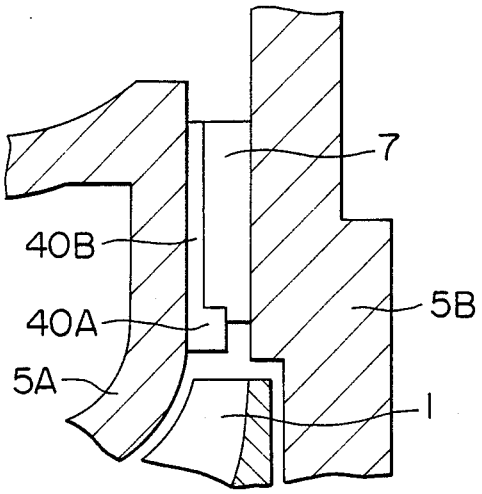

In FIG. 14, the structure of the embodiment shown in FIG. 10 is simplified, in which the outlet-side intermediate blade 40C is omitted. In this case, although slight decrease in performance cannot be avoided, the cost of the diffuser can be reduced.

Figure 15:
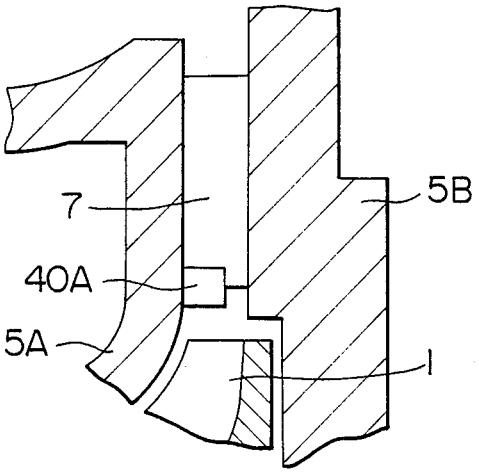

In the simplified construction of FIG. 15, the rectifier blade 40B and the outlet intermediate blade 40C are omitted, and as a result, it being constituted by inlet-side intermediate blade 40A only.

As described above, according to the present invention, since the diffuser which converts kinetic or speed energy of the air flow discharged from an impeller of a centrifugal compressor or air fan into pressure energy and which is provided with a plurality of stator blades has inlet-side intermediate blades whose height is shorter than a height of the stator blade, the operating flow rate range of the diffuser can be enlarged without deterioration in performance, so that the operating flow rate range of the centrifugal compressor or air fan can be significantly enlarged.

What is claimed is:

1. A diffuser of a centrifugal compressor including a plurality of stator blades disposed on an outside of an impeller thereof, and which converts kinetic energy of fluid discharged from said impeller into pressure energy by operation of said stator blades, said diffuser comprising sub-blades having a cord length shorter a cord length of said stator blades disposed near inner ends of and between said plurality of stator blades, one side surface of each of said sub-blades confronting said stator blade, the other side surface of each of said sub-blades not confronting a neighboring stator blade, said sub-blades being situated at positions intersecting a circle having a center thereof at a center of a rotational shaft of said impeller and which passes through the inner end of said stator blade.

2. A diffuser of a centrifugal compressor according to claim 1, wherein each of said sub-blades is disposed at a position not intersecting a perpendicular line which is drawn to one of said stator blades at the inner end of said one stator blade which confronts said each sub-blade.

3. A diffuser of a centrifugal compressor according to claim 2, wherein said sub-blade is rotatably supported by a supporting shaft disposed in parallel to a rotational shaft of said impeller.

4. A diffuser of a centrifugal compressor according to claim 1, wherein said sub-blade is rotatably supported by a supporting shaft disposed in parallel to a rotational shaft of said impeller.

5. A diffuser of a centrifugal compressor according to claim 1, wherein a distance between the inner end of said sub-blade and said stator blade confronting said sub-blade and a distance between the outer end of said sub-blade and said stator blade is arranged to be different.

6. A diffuser of a centrifugal compressor including a plurality of stator blades disposed on an outside of an impeller thereof, and which converts kinetic energy of fluid discharged from said impeller into pressure energy by operation of said stator blades, said diffuser comprising sub-blades having a cord length shorter than a cord length of said stator blades and which are disposed near the inner ends of and between said plurality of stator blades, one side surface of said sub-blades confronting said stator blades, said sub-blades being situated by the positions intersecting a circle having a center thereof a center of a rotational shaft of said impeller and which passes through the inner ends of said stator blade; and intermediate blades disposed near the outer ends of and between said plurality of stator blades, said intermediate blades have a cord length shorter than a cord length of said stator blades, each of which extends through a middle point of a perpendicular line drawn from an outer edge of said stator blades to a neighboring blade or to an extension of inside of said neighboring blade, whose outer edge reaches a circle which passes through an outer edge of said stator blade, a length of said intermediate blade disposed inside said middle point of said perpendicular line being within 20% of the overall length of said intermediate blade, and a whole shape of said intermediate blade is formed in such a manner that if said intermediate blade is assumed to be rotationally displaced around the center of a rotational shaft of said impeller, said intermediate blade is included in a contour of said stator blade.

7. A diffuser of a centrifugal compressor according to claim 6, wherein said intermediate blade is rotatably supported by a supporting shaft disposed in parallel to said rotational shaft of said impeller.

8. A diffuser of a centrifugal compressor according to claim 6, wherein a distance between the inner end of said intermediate blade and said stator blade confronting said intermediate blade and distance between the outer end of said intermediate blade and distance between the outer end of said intermediate blade and said stator blade is arranged to be different.

9. A diffuser of a centrifugal compressor comprising a plurality of stator blades disposed outside of an impeller thereof, and which converts kinetic energy of fluid discharged from said impeller into pressure energy by operation of said stator blades, said diffuser comprising intermediate disposed between said plurality of stator blades, each of said intermediate blades comprises an inlet-side intermediate blade having a cord length and a height smaller than a cord length and height of said stator blade, one side surface of each of said intermediate blades confronting said stator blade, the other side surface of each of said intermediate blades not confronting a neighboring intermediate blade, and said intermediate blades are situated at positions intersecting a circle which has a center thereof at a center of a rotational shaft of said impeller and which passes through inner ends of said stator blades.

10. A diffuser of a centrifugal compressor comprising a plurality of stator blades disposed outside of an impeller thereof, and which converts kinetic energy of fluid discharged from said impeller into pressure energy by operation of said stator blades, said diffuser comprising intermediate blades disposed between said plurality of stator blades, each of said intermediate blades comprises an inlet-side intermediate blade having a cord length and a height smaller than a cord length and height of said stator blade, and wherein said intermediate blade includes a rectifier blade disposed at a downstream side of said inlet-side intermediate blade, and a height shorter than a height of said inlet-side intermediate blade.

11. A diffuser of a centrifugal compressor according to claim 10, wherein an outlet-side intermediate blade is provided at a downstream side of said rectifier blade.

12. A diffuser of a centrifugal compressor comprising a plurality of stator blades disposed outside of an impeller thereof, and which converts kinetic energy of fluid discharged from said impeller into pressure energy by operation of said stator blades, said diffuser comprising intermediate blades disposed between said plurality of stator blades, each of said intermediate blades comprises an inlet-side intermediate blade having a cord length and a height smaller than a cord length and height of said stator blade, and wherein said intermediate blades, each having said inlet-side intermediate blade, said rectifier blade and said outlet-side intermediate blade, are provided in a confronting manner with each manner in said diffuser portion.

* * * * *